US007001150B2

(12) United States Patent
Fett et al.

(10) Patent No.: US 7,001,150 B2
(45) Date of Patent: Feb. 21, 2006

(54) HOLLOW TURBINE BLADE STIFFENING

(75) Inventors: Steven John Fett, Kirkland (CA); Scott Walker Smith, St. Lambert (CA); Bich Nhu Le, St. Laurent (CA)

(73) Assignee: Pratt & Whitney Canada Corp., Longueuil (CA)

( * ) Notice: Subject to any disclaimer, the term of this patent is extended or adjusted under 35 U.S.C. 154(b) by 179 days.

(21) Appl. No.: 10/685,707

(22) Filed: Oct. 16, 2003

(65) Prior Publication Data

US 2005/0084380 A1 Apr. 21, 2005

(51) Int. Cl.
*F01D 5/14* (2006.01)

(52) U.S. Cl. ..... 416/1; 416/231 R; 416/500

(58) Field of Classification Search ..... 416/232, 416/233, 1, 231 R, 500
See application file for complete search history.

(56) References Cited

U.S. PATENT DOCUMENTS

| | | | | |
|---|---|---|---|---|
| 2,615,520 A | | 10/1952 | Liedholm | 170/159 |
| 2,925,996 A | | 2/1960 | Stalker | |
| 2,954,208 A | | 9/1960 | Ewald et al. | 253/77 |
| 3,310,116 A | | 3/1967 | Saeki et al. | 170/159 |
| 3,383,093 A | | 5/1968 | Howald | |
| 3,606,580 A | | 9/1971 | Kaufman, Sr. | 416/232 |
| 3,626,568 A | | 12/1971 | Silverstein et al. | 29/156.8 |
| 3,761,201 A | | 9/1973 | Silverstein et al. | 416/232 |
| 3,825,984 A | | 7/1974 | Linko et al. | 29/156.8 |
| 4,650,399 A | | 3/1987 | Craig et al. | |
| 5,328,331 A | * | 7/1994 | Bunker et al. | 416/96 R |
| 5,407,326 A | | 4/1995 | Lardellier | 416/233 |
| 5,692,881 A | * | 12/1997 | Leibfried | 416/233 |
| 5,988,982 A | | 11/1999 | Clauer | |
| 6,033,186 A | | 3/2000 | Schilling et al. | 416/233 |
| 6,193,468 B1 | | 2/2001 | Beeck et al. | 416/232 |
| 6,481,972 B1 | * | 11/2002 | Wang et al. | 416/233 |

FOREIGN PATENT DOCUMENTS

| | | |
|---|---|---|
| EP | 1 217 171 | 6/2002 |
| JP | 60228705 | 11/1985 |

* cited by examiner

*Primary Examiner*—Ninh H. Nguyen
(74) *Attorney, Agent, or Firm*—Ogilvy Renault

(57) ABSTRACT

An apparatus and method for at least one of stiffening a rotor blade of a gas turbine engine and raising a natural vibration frequency of the blade. The blade has a recess extending radially and inwardly into the blade. A reinforcing element is provided in the recess at a selected position to thereby allow a large blade chord at the tip end of the blade.

11 Claims, 6 Drawing Sheets

HOLLOW TURBINE BLADE STIFFENING

THE FIELD OF THE INVENTION

The field of the invention relates generally to gas turbine engines, and more particularly to hollow rotor blades such as turbine blades thereof.

BACKGROUND OF THE INVENTION

A hollow turbine blade 10 as illustrated in FIG. 1A generally includes an airfoil shaped body 12 extending radially between a tip end 14 and a rotor portion 16, extending axially between a leading edge 18 and a trailing edge 20. The turbine blade 10 is mounted to a rotor disk 22 by, for example, a "fir tree" attachment (not shown). A pocket or recess 30 is provided at the tip end 14 of the otherwise solid blade body 12. A creep pin 32 may optionally be provided for use in measuring blade creep. To permit accurate measurements to be made, the creep pin 32 is located close to the tip end 14, and axially where the pocket or recess 30 is widest, i.e. toward the leading edge side of the pocket, to thereby facilitate access by the appropriate measuring tools.

The presence of pocket or recess 30 tends to decrease both the bending and torsional stiffness of the blade 10, or moments of inertia, of the airfoil shaped body 12, which adversely affects the various vibration and bending modes of the blade 10. As a result, a phenomenon known as "second mode bending" can cause a large chord blade to bend, somewhat analogous to flapping like a flag or sail in a breeze. Therefore, the blade chord is usually shortened in region 20' near the tip end 14, in order to minimize the effect this type of blade trailing edge bending. In essence, the problem is negated by removing or reducing the size of the portion of the blade (i.e. region 20') most susceptible to second mode bending. Narrowing the blade chord, however, detrimentally affects the turbine performance because a turbine blade with the shortened chord gets less power from combustion gas flow. Therefore, improvements to hollow blades are desirable.

SUMMARY OF THE INVENTION

One object of the present invention is to provide improvements to a hollow blade of a gas turbine engine.

In accordance with one aspect of the present invention, there is provided a rotor blade of a gas turbine engine, the rotor blade comprising: an airfoil extending from a root end to a tip end, the root end mounted to a connection apparatus for securing the blade to the engine, the airfoil having a leading edge, a trailing edge and an outer periphery, the outer periphery defined by a pressure side and a suction side each extending from the leading edge to the trailing edge; a recess defined in the airfoil extending from tip end towards the root end, the recess having first and second sides corresponding to the airfoil pressure and suction sides; and at least one reinforcing element disposed in the recess and extending from the first side to the second side, the element disposed in the recess in a position adapted, in use, to minimize a trailing edge bending of the blade by reason of said position of the element in the recess.

In accordance with another aspect of the present invention, there is provided a rotor blade of a gas turbine engine, the rotor blade comprising an airfoil extending from a root end to a tip end, the root end mounted to a connection apparatus for securing the blade to the engine, the airfoil having a leading edge, a trailing edge and an outer periphery, the outer periphery defined by a pressure side and a suction side each extending from the leading edge to the trailing edge; a recess defined in the airfoil extending from tip end towards the root end, the recess having first and second sides corresponding to the airfoil pressure and suction sides, the recess having a widest point, the widest point being that having a widest perpendicular distance between the first side and the second side; and at least one reinforcing element disposed in the recess and extending from the first side to the second side, the element positioned in the recess aft of said widest point.

In accordance with another aspect of the present invention, there is provided a method for impeding second mode bending in a trailing edge portion of a hollow rotor blade of a gas turbine engine, the hollow blade having a recess defined in a tip end thereof, the recess extending into the blade toward a root end, the method comprising the steps of providing a desired blade geometry; analyzing the geometry to determine at least one second mode bending characteristic of the blade geometry; and providing a reinforcing element the recess of the blade at a selected position of the blade, the selected position adapted to permit the element to minimize second mode bending in the trailing edge portion of the blade.

The reinforcing element preferably comprises a stiffening pin extending across the recess and being secured at opposed ends thereof to the respective sides of the body of the blade.

The present invention advantageously provides a simple method and configuration for improvement of a rotor blade, particularly a turbine blade having an open ended recess therein at the tip end thereof such that the blade chord at the tip end may be maximized in order to maximize blade performance while minimizing trailing edge second mode bending.

BRIEF DESCRIPTION OF THE DRAWINGS

Having thus generally described the nature of the present invention, reference will now be made to the accompanying drawings, showing by way of illustration the preferred embodiments thereof, in which.

DETAILED DESCRIPTION OF THE PREFERRED EMBODIMENT

Figure 2:
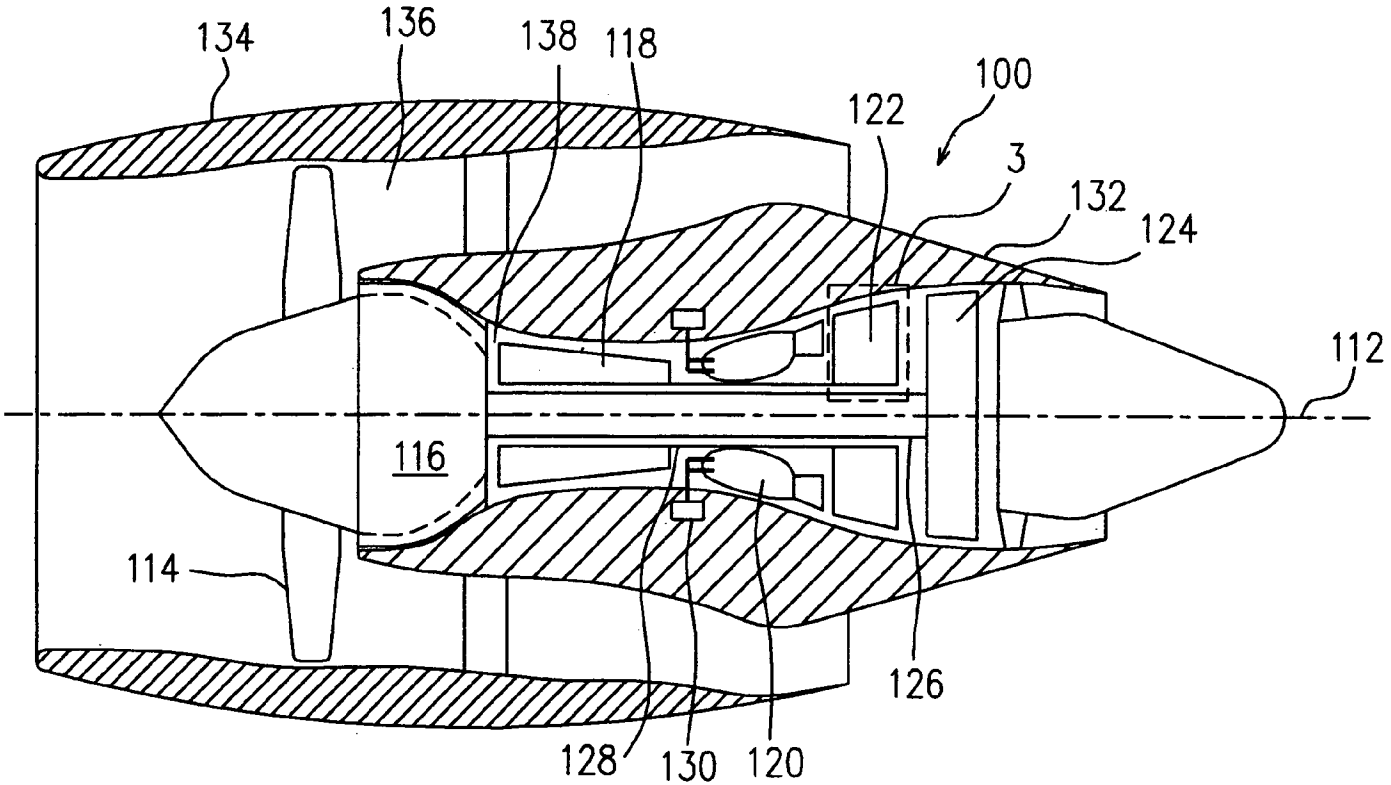
FIG. 2 is a cross-sectional schematic view of a gas turbine engine incorporating one embodiment of the present invention.

FIG. 2 illustrates an exemplary gas turbine engine 100 which includes in serial flow communication about a longitudinal center axis 112, a fan having fan blades 114, a low pressure compressor 116, a high pressure compressor 118, a combustor 120, and high and low pressure turbines 122, 124 which include turbine blades according to one embodiment of the present invention and which will be further described in detail hereinafter. The low pressure turbine 124 is operatively connected to both the low pressure compressor 116 and the fan blades 114 by a first rotor shaft 126, and the high pressure turbine 122 is operatively connected to the high pressure compressor 118 by a second rotor shaft 128. Fuel injection means 130 are provided for selectively injecting fuel into the combustor 120 for powering the engine 100.

A annular casing 132 surrounds the low and high pressure compressors 116, 118, the 120 and the high and low pressure turbines 122, 124, to form a main airflow path 138 axially extending therethrough. A nacelle 134 surrounds the fan blades 114 and the casing 132 to define a bypass duct 136. Thus, a portion of airflow entering the main flow path 138 is compressed by the low and high pressure compressors 116, 118, and is then mixed with fuels injected by the fuel injecting means 130, for combustion in the combustor 120. Combustion gases exiting the combustor 120 drive the high and low pressure turbines 122, 124 and are then discharged from the engine 100. A portion of airflow compressed by the fan blades 114 passes through the bypass duct 136 and is discharged from the engine 100.

Figure 3B:
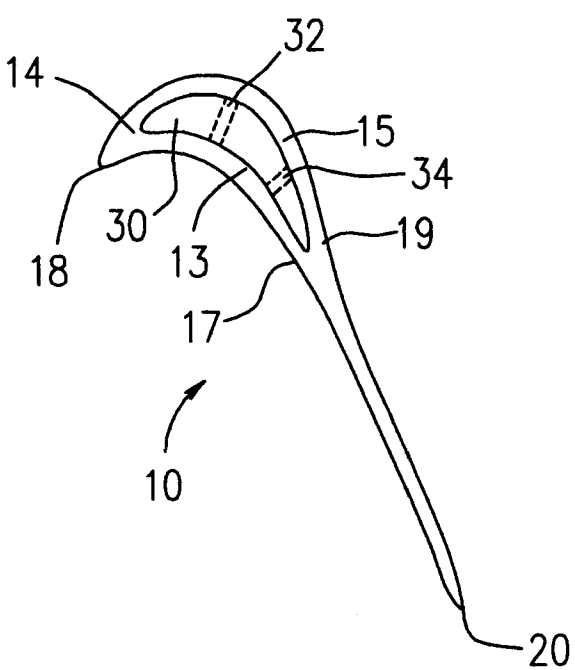
FIG. 3B is a top plan view of a tip end of the turbine blade illustrated in FIG. 3A.
Figure 3A:
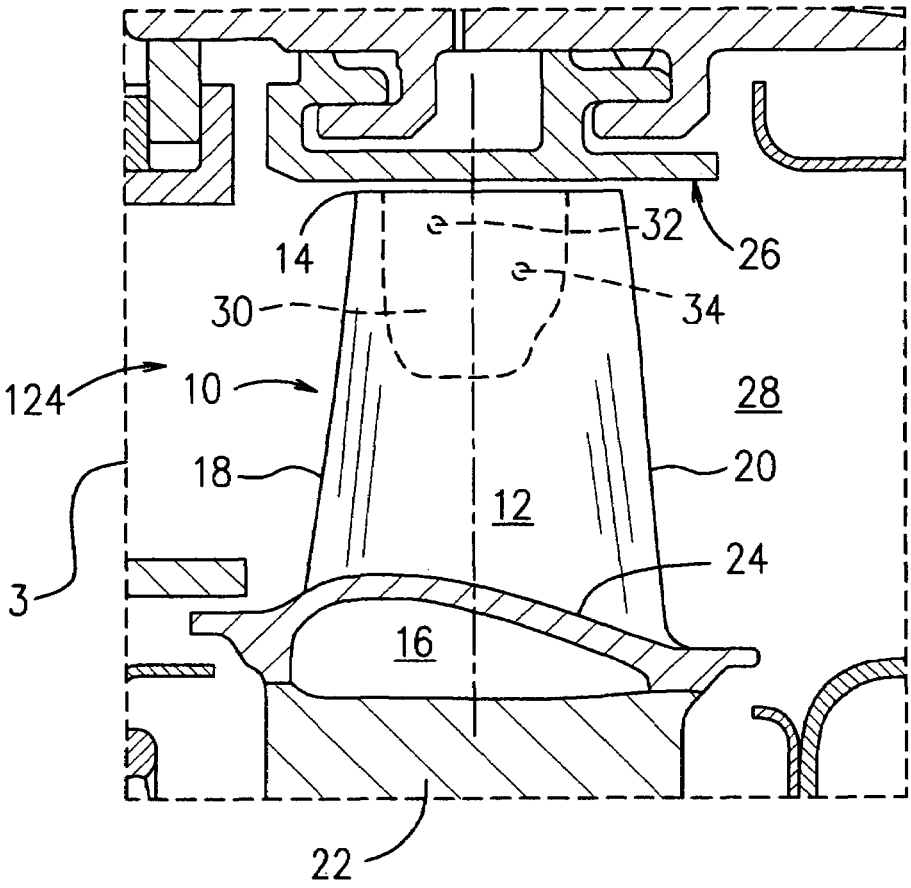
FIG. 3A is a cross-sectional view of a turbine section of the gas turbine engine of FIG. 2, indicated by numeral 3, depicting the detail thereof.
Figure 3C:
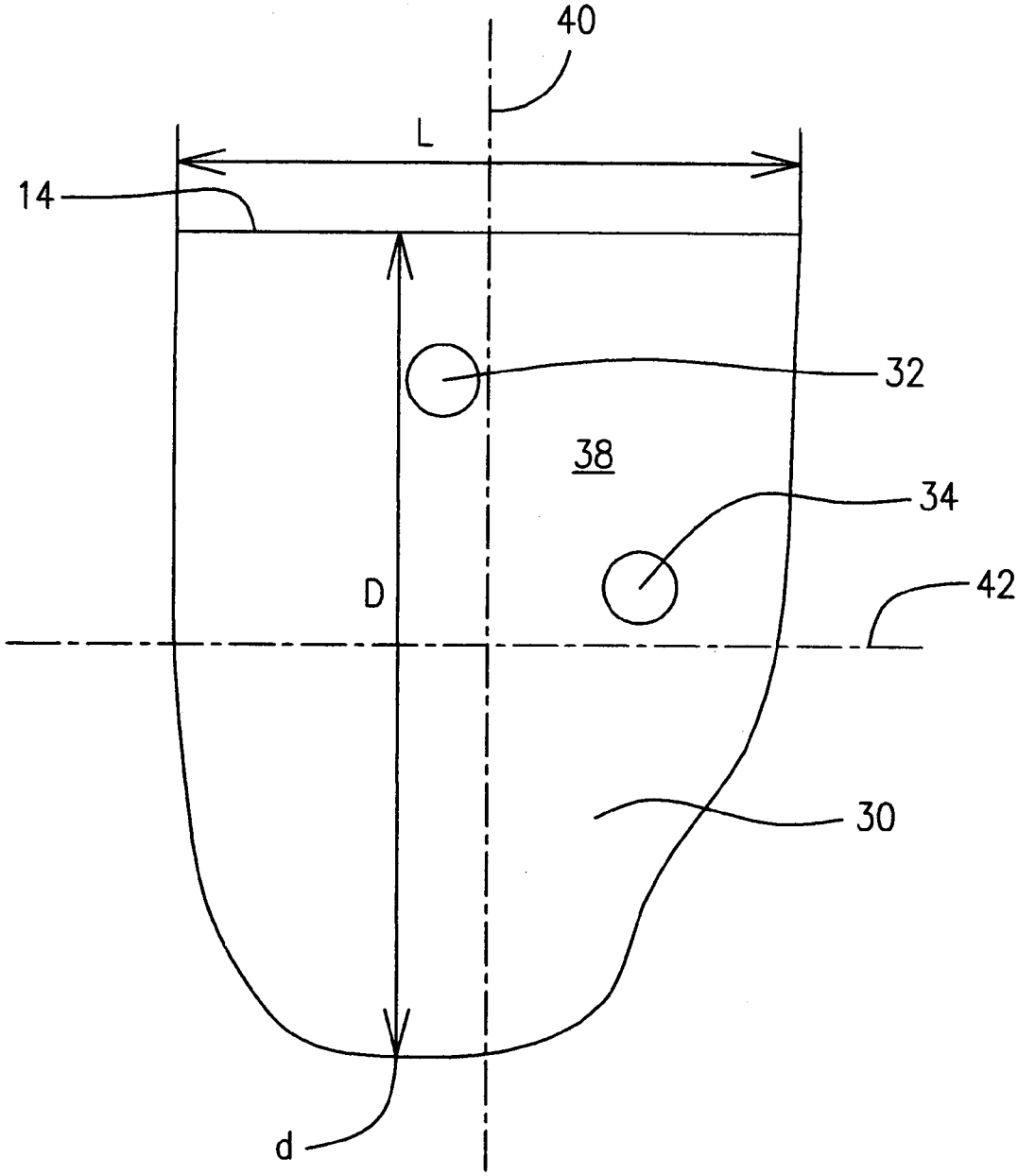
FIG. 3C is a schematic view of the recess defined in the blade of FIG. 3A, illustrating four quadrants thereof.

FIGS. 3A–3C illustrate details of the high pressure turbine section 122 of the present invention which is indicated by numeral 3 in FIG. 2. A turbine blade, indicated by reference numeral 10, according to the present invention is depicted, which generally includes an airfoil shaped body 12 extending radially between a tip end 14 and a rotor portion or root end 16, extending axially between a leading edge 18 and a trailing edge 20. The airfoil body 12 has a pressure side 17 and a suction side 19 extending respectively between leading edge 18 and trailing edge 20. The turbine blade 10 is mounted to a rotor disk 22 by, for example, a "fir tree" attachment apparatus (not shown) mounted to the blade adjacent root end 16. A gas turbine shroud which is usually formed as a segmented shroud assembly 26 constitutes a radial outer boundary of the flow path 28. The flow path 28 is a section of the main flow path 138 of FIG. 2. An opening is defined at the tip end 14 of the blade 10, and thereby forms a recess 30 extending radially inwardly into the solid blade body 12 from tip end 14 towards root end 16. The recess 30 may typically extend into the blade at least 25% of the blade's overall height (i.e. the distance between root end 16 and tip end 14), and more preferably from about 50% to 75% of the blade's height. The recess has sides 13 and 15, corresponding to pressure side 17 and suction side 19 respectively.

A creep pin 32 may optionally be provided in recess 30 for use in measuring the creep elongation of the blade 10. The creep pin 32 is located radially close to the tip end 14, and axially where the recess 30 is widest to thereby facilitate creep measurement. (Location of the creep pin elsewhere in the recess would make the pin inaccessible for such measurement and thereby frustrate its purpose.) The widest position of the recess 30 corresponds to the widest portion of the airfoil, and is thus located forward of chord centreline 40. Chord centreline 40 is midway between leading edge 18 and trailing edge 20.

In accordance with the present invention, a reinforcing element, in this case a stiffening pin 34, is provided in the recess 30 of the blade 10 at a position of the blade selected so as to permit the pin to minimize trailing edge second mode bending of the blade 10. The element provides stiffness to the shape of the hollow blade, and helps the blade maintain its unloaded shape, which thereby tends to resist the operational forces which cause second mode bending. In order to achieve such purpose, however, the placement of the element is critical.

Referring now to FIGS. 3B–3C, the stiffening pin 34 is preferably located in an upper, rear portion of the recess (as this is the portion of the blade susceptible to second mode bending), and extends across the recess 30 from side 13 to side 15 of the interior of the recess 30 of the blade 10. For description purposes herein, the recess 30 may be divided into four quadrants as shown in FIG. 3C, two on either side of chord centreline 40 and two on each side of pocket midline 42. The length L is the axial length of the opening of the recess 30. The depth D is measured from the top end 14 where the opening of the recess 30 is defined, to the deepest point d of the bottom of the recess 30. The deepest point d may not necessarily be at the middle of the bottom of the recess 30, depending on the geometry of the recess 30. The midline 42 is midpoint between tip end 14 and deepest point d, and thus divides recess into two halves. As mentioned above, D may be at least 25% the height of blade 10, and preferably about 50%, and as much as 75%, or greater, of the height of blade 10.

As mentioned, the position of the stiffening pin 34 within the recess 30 is determined in order to minimize the second mode edge bending of the airfoil adjacent its trailing edge, and thus the exact position of pin 34 relative to the blade will be affected by the particular configuration of the airfoil body 12 and the geometry of the recess 30. Referring again to FIG. 1A, it is the area of the blade in and adjacent region 20' which is most susceptible to second mode bending because this is the most flexible portion of the blade, being thinnest portion of the airfoil chord and being remote from the secure connection of the airfoil to its platform adjacent root end 16. Referring again to FIG. 3C, it is thus quadrant 38 which is most susceptible to bending, and in particular second mode bending, and thus it is in this region wherein location of pin 34 will be most beneficial according to the present invention. It will be understood in light of these teachings that quadrant 38 corresponds approximately to an area of the blade most susceptible to second mode bending.

Figure 1A:
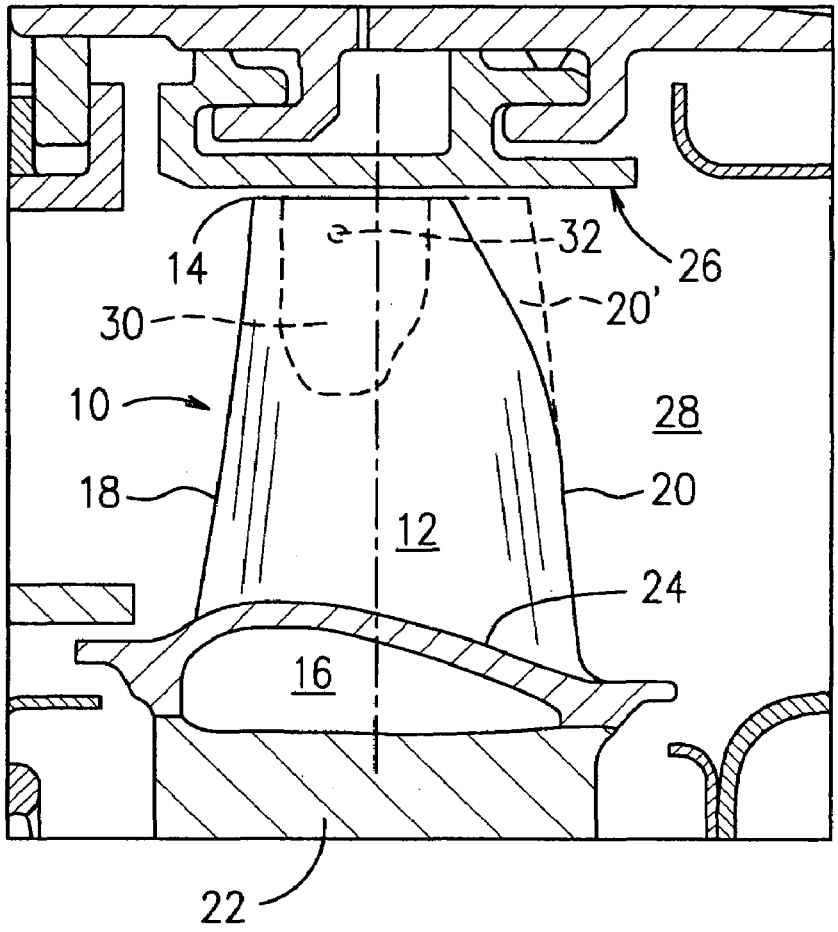
FIG. 1A (PRIOR ART)
FIG. 1A is a cross-sectional view of a turbine section of a gas turbine engine, showing a prior art hollow turbine blade having an open ended recess therein at a tip end thereof.
Figure 1B:
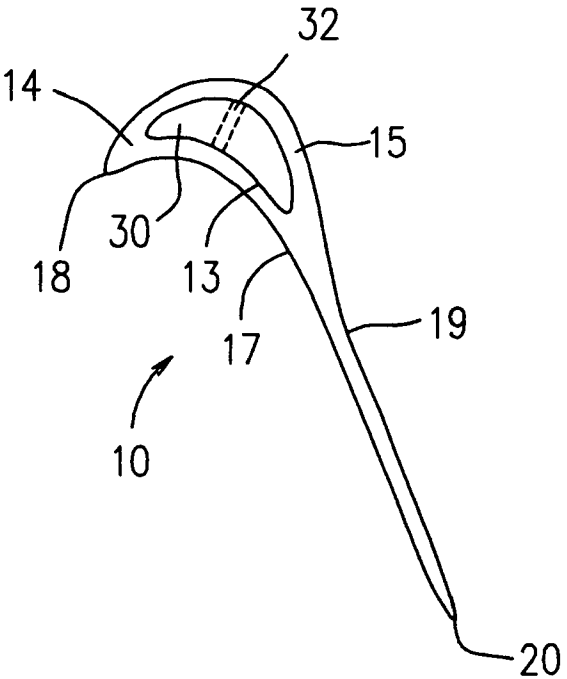
FIG. 1B (PRIOR ART)
FIG. 1B is a top plan view of the blade tip of the turbine blade of FIG. 1A.

Hence, pin 34 is located in quadrant 38. When the stiffening pin 34 is so provided within the recess 30 of the blade 10, the trailing edge second mode bending is effectively minimized. Therefore, it is not necessary to shorten the blade chord at the tip end to control bending, as with the prior art discussed above. Thus, the trailing edge 20 need not be cut back as shown in FIG. 1A, but rather may extend relatively more straightly and thereby permit the designer to provide a relatively larger blade chord at the tip end. A larger recess or pocket 30 is also permitted, as can be seen from a comparison of FIGS. 1B and 3B. The turbine blade 10 having larger blade chord gains more power from the combustion gases flowing therethrough under the same engine operation condition, which therefore improves the engine performance. The addition of stiffening pin 34 will also raise the natural vibration frequency of the blade 10, which is also desirable for improvement of overall aerodynamic features of the turbine, as will be discussed further below.

One skilled in the art will immediately recognize, however, that the creep pin 32 is, by reason of its relatively forward position within the pocket 30, much less effective in mitigating against second mode bending because it is positioned remote from the area where second mode bending is chiefly a problem. The stiffening pin 34, however, is advantageously placed to reduce, or ideally altogether prevent, bending such as second mode bending.

The blade 10 is preferably fabricated in a casting process to form a unitary blade part, and it is preferable that the pin 34 is integrally provided together with the blade, as this facilitates reliable operation under high speed and high temperature conditions.

More than one reinforcing element according to the present invention may be employed, and the inventor has found this may be beneficially employed to raise the natural vibration frequency of the blade with only minimum of additional weight. Although the addition of reinforcing elements in the recess 30 at any location will generally affect the natural vibration frequency and bending stiffness of the blade 10, the effect of the addition of the second or more reinforcing elements will be greatest in certain locations, depending on the blade design. Therefore, when the number of reinforcing elements and the first element location are determined, the location of each subsequent element may preferably be selected to raise the natural vibration frequency of the blade to a maximum level. The inventor prefers the placing such additional elements also in quadrant 38.

Figure 4:
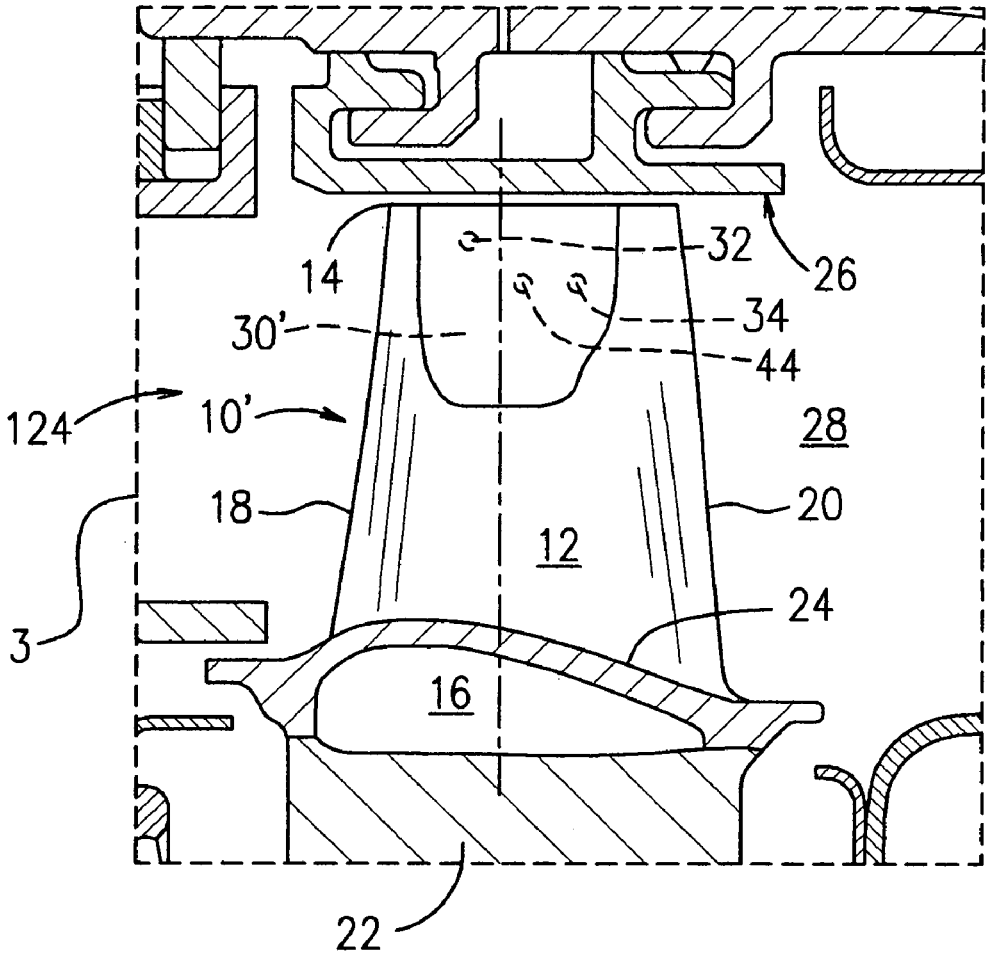
FIG. 4 is a cross-sectional view similar to FIG. 3A, showing a turbine section according to another embodiment of the present invention.

FIG. 4 thus illustrates another embodiment of the present invention, in which blade 10' is similar to the blade 10 in FIGS. 3A and 3B, and includes similar parts and features indicated by similar numerals, and will not therefore be redundantly described herein. The recess 30' has a relatively large opening (compared with the prior art) at the tip end 14, in contrast to the embodiment of FIGS. 3A and 3B. A second reinforcing element, in this case pin 44 similar to pin 32, is added. The position of the second stiffening pin 44 is preferably selected such that the addition of the second stiffening pin 44 beneficially increases the natural vibration frequency of the blade 10' above a predetermined level to thereby improve the performance of the blade 10.

Still further reinforcing elements may be added into the recess 30' of the blade 10' in order to further increase bending stiffness and/or raise the natural vibration frequency of the blade 10' as desired. One or more elements may be provided to address one of these problems alone, or both problems together.

Although a turbine blade has been taken as an example illustrating the preferred embodiment of the present invention, the approach is applicable to other hollow rotor blades. Stiffening pins have been presented as one example of the present invention, nevertheless any other structural element (e.g. non-pin-like or non-circular cross-section) which substantially achieves the same result as the stiffening pin(s) described above may be used. A cylindrical shape is preferred to reduce weight and facilitate casting of the element. A turbofan gas turbine engine having a short cowl nacelle is present as an example to illustrate the environment of the present invention, however, any other type of gas turbine engines is suitable for employing rotor blades according to the present invention. Other applications outside the field of gas turbines may be apparent to those skilled in the art.

Modifications and improvements to the above-described embodiments of the present invention may therefore become apparent to those skilled in the art. The foregoing description is intended to be exemplary rather than limiting. The scope of the present invention is therefore intended to be limited solely by the scope of the appended claims.

What is claimed is:

1. A rotor blade of a gas turbine engine, the rotor blade comprising:

an airfoil extending from a root end to a tip end, the root end mounted to a connection apparatus for securing the blade to the engine, the airfoil having a leading edge, a trailing edge and an outer periphery, the outer periphery defined by a pressure side and a suction side each extending from the leading edge to the trailing edge;

an open recess defined in the tip end of the airfoil extending from the tip end towards the root end, the recess having first and second sides corresponding to the airfoil pressure and suction sides; and at least one reinforcing element disposed in the recess and extending from the first side to the second side, the element disposed in the recess in a position adapted, in use, to minimize a trailing edge bending of the blade by reason of said position of the element in the recess.

2. The rotor blade as claimed in claim 1 wherein the reinforcing element comprises a stiffening pin.

3. The rotor blade as claimed in claim 1 wherein the recess extends into the airfoil at least 50 percent of a distance between the tip end and the root end.

4. The rotor blade as claimed in claim 1 wherein the recess first and second sides extend from a recess leading edge side to a recess trailing edge side, and wherein the element in located closer to the recess trailing edge side than to the recess leading edge side.

5. The rotor blade as claimed in claim 1 comprising at least a second element extending across the recess from the first side to the second side.

6. The rotor blade as claimed in claim 5 wherein the second element is selectively positioned within the recess to raise a natural vibration frequency of the blade.

7. A rotor blade of a gas turbine engine, the rotor blade comprising:

an airfoil extending from a root end to a tip end, the root end mounted to a connection apparatus for securing the blade to the engine, the airfoil having a leading edge, a trailing edge and an outer periphery, the outer periphery defined by a pressure side and a suction side each extending from the leading edge to the trailing edge;

an open recess defined in the tip end of the airfoil extending from the tip end towards the root end, the recess having first and second sides corresponding to the airfoil pressure and suction sides, the recess having a widest point, the widest point being that having a widest perpendicular distance between the first side and the second side; and at least one reinforcing element disposed in the recess and extending from the first side to the second side, the element positioned in the recess aft of said widest point.

8. A method for impeding second mode bending in a trailing edge portion of a hollow rotor blade of a gas turbine engine, the hollow blade having a recess defined in a tip end thereof, the recess extending into the blade toward a root end, the method comprising the steps of:

providing a desired blade geometry;

analyzing the geometry to determine at least one second mode bending characteristic of the blade geometry; and providing a reinforcing element the recess of the blade at a selected position of the blade, the selected position adapted to permit the element to minimize second mode bending in the trailing edge portion of the blade.

9. The method as claimed in claim 8 wherein the reinforcing element comprises a stiffening pin extending across the recess.

10. The method as claimed in claim 8 wherein the selected position is closer to a blade trailing edge than to a blade leading edge, and wherein the selected position is located closer to the blade tip end than to the root end.

11. The method as claimed in claim 8 further comprising the step of providing at least a second element into the recess, the second element extending across the recess, the second element provided at a second selected position, the second selected position adapted to raise a natural vibration frequency of the blade.

* * * * *